US008978461B2

(12) United States Patent
Li et al.

(10) Patent No.: US 8,978,461 B2
(45) Date of Patent: Mar. 17, 2015

(54) APPARATUS AND MEASURING STRESS IN A SUBTERRANEAN FORMATION

(75) Inventors: Gang Li, Houston, TX (US); Kenneth E. Williams, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 345 days.

(21) Appl. No.: 13/392,301

(22) PCT Filed: Aug. 31, 2009

(86) PCT No.: PCT/US2009/055484

§ 371 (c)(1),
(2), (4) Date: Feb. 24, 2012

(87) PCT Pub. No.: WO2011/025498

PCT Pub. Date: Mar. 3, 2011

(65) Prior Publication Data

US 2012/0152010 A1 Jun. 21, 2012

(51) Int. Cl.
*E21B 49/00* (2006.01)
*E21B 47/00* (2012.01)

(52) U.S. Cl.
CPC ..... *E21B 49/006* (2013.01); *E21B 47/0006* (2013.01)
USPC ..... 73/152.59; 73/152.49

(58) Field of Classification Search
CPC ..... E21B 49/006; E21B 47/0006
USPC ..... 73/152.54, 152.59; 702/11
See application file for complete search history.

(56) References Cited

U.S. PATENT DOCUMENTS

| | | | | |
|---|---|---|---|---|
| 3,234,788 | A * | 2/1966 | Antoine-Auguste Talobre | 73/152.59 |
| 3,961,524 | A * | 6/1976 | de la Cruz | 73/783 |
| 4,030,345 | A * | 6/1977 | Edmond et al. | 73/784 |
| 4,149,409 | A * | 4/1979 | Serata | 73/152.03 |
| 5,381,690 | A | 1/1995 | Kanduth et al. | |
| 5,482,116 | A * | 1/1996 | El-Rabaa et al. | 166/250.1 |
| 5,511,615 | A | 4/1996 | Rhett | |
| 5,517,854 | A * | 5/1996 | Plumb et al. | 73/152.59 |
| 5,576,485 | A * | 11/1996 | Serata | 73/152.17 |
| 5,967,232 | A | 10/1999 | Rhett | |
| 8,417,457 | B2 * | 4/2013 | Franquet | 702/11 |
| 2004/0237640 | A1 | 12/2004 | Meister et al. | |

OTHER PUBLICATIONS

International Search Report and Written Opinion issued May 28, 2010 in International Patent Application No. PCT/US2009/055484.

(Continued)

*Primary Examiner* — Peter Macchiarolo
*Assistant Examiner* — Nathaniel Kolb

(57) ABSTRACT

A method and apparatus for determining a stress field in a subterranean formation include deploying a stress measurement tool on a tubular string, opening at least three fractures in three different radial directions in the subterranean formation, and closing the at least three fractures. The at least three fractures are reopened while measuring stress and strain conditions. From the reopening, a tangential stress component for each of the at least three fractures is determined. From the tangential stress components and radial directions of the at least three fractures, the stress field of the subterranean formation is determined.

16 Claims, 5 Drawing Sheets

(56) References Cited

OTHER PUBLICATIONS

Li, G. et al. Experimental and Numerical Study for Stress Measurement and Estimation in Rock Mass. Presented at SINOROCK2009—International Symposium on Rock Mechanics—Rock Characterization, Modeling and Engineering Design Methods. The University of Hong Kong. May 19-22, 2009.

Machine translation of Japanese published patent application JP 2004-020432, published Jan. 22, 2004.

Machine translation of Japanese published patent application JP 2005-037313, published Oct. 2, 2005.

* cited by examiner

APPARATUS AND MEASURING STRESS IN A SUBTERRANEAN FORMATION

BACKGROUND

Stress within subterranean formations affects the mechanical and fluid properties of those subterranean formations. Accordingly, knowledge of the magnitude and orientation of that stress (the "stress field") is useful for planning and drilling a wellbore that traverses those subterranean formations. Knowledge of the stress field is also useful for planning and conducting the fracturing of a subterranean formation that contains hydrocarbons. Presently, stress field data is limited to estimates based on limited data and modeling. Any improvements in determining the actual stress field components are valuable for planning, drilling, and producing from a well.

BRIEF DESCRIPTION OF THE DRAWINGS

For a more detailed description of the embodiments, reference will now be made to the following accompanying drawings.

DETAILED DESCRIPTION OF THE DISCLOSED EMBODIMENTS

The present disclosure relates to a stress measurement system for a subterranean formation and includes embodiments of different forms. The drawings and the description below disclose specific embodiments with the understanding that the embodiments are to be considered an exemplification of the principles of the invention, and are not intended to limit the invention to that illustrated and described. Further, it is to be fully recognized that the different teachings of the embodiments discussed below may be employed separately or in any suitable combination to produce desired results. The term "couple," "couples," or "coupled" as used herein is intended to mean either an indirect or a direct connection. Thus, if a first device couples to a second device, that connection may be through a direct connection; e.g., by conduction through one or more devices, or through an indirect connection; e.g., by convection or radiation.

Figure 1:
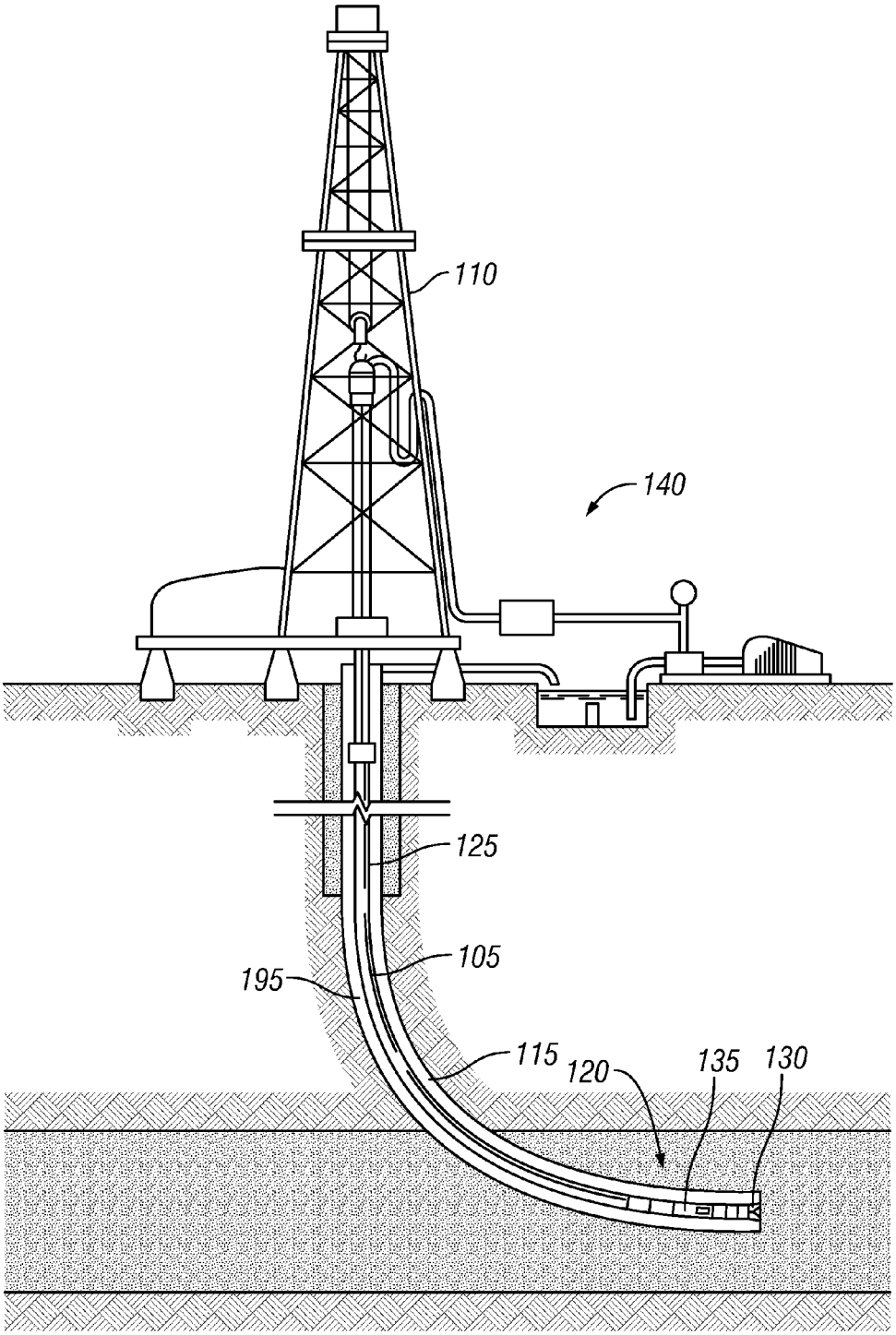
FIG. 1 is a schematic representation of a drilling system including a downhole tool with a stress measurement tool according to the principles disclosed herein.

Referring now to FIG. 1, a drilling system 140 including a stress measurement tool 135 according to the principles disclosed herein is depicted. Drilling system 140 further includes a drill string 105 suspended from a rig 110 into a wellbore 115. Drill string 105 includes a drill pipe 125 that may be made up of a plurality of sections and to which a BHA 120 is coupled. BHA 120 includes a drill bit 130 and may include other components, such as but not limited to a drill sub, a motor, steering assembly, and drill collars. During drilling, drilling fluid, or "drilling mud," is circulated down through drill string 105 to lubricate and cool drill bit 130 as well as to provide a vehicle for removal of drill cuttings from wellbore 115. After exiting drill bit 130, the drilling fluid returns to the surface through an annulus 195 between drill string 105 and wellbore 115.

Embodiments of the stress measurement tool 135 are configured to measure stress and strain during and after mechanically fracturing a wellbore in a selected subterranean formation (hereinafter the "formation"). The mechanical fracturing of the wellbore is performed in a manner that controls the direction in which mechanical force is applied in order to determine direction and magnitude of the stress field for the formation. At least three mechanical fractures are created by the stress measurement tool 135 in different directions. Combined with knowledge of the orientation of the mechanical fractures, the stress and strain measurements may then be used to determine the stress field for the formation, which is discussed in greater detail below.

Figure 2:
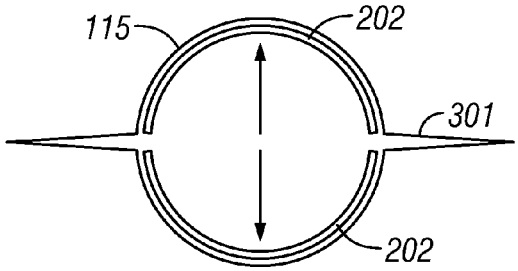
FIG. 2 illustrates a mechanically induced fracture in a formation according to the principles disclosed herein.
Figure 3A:
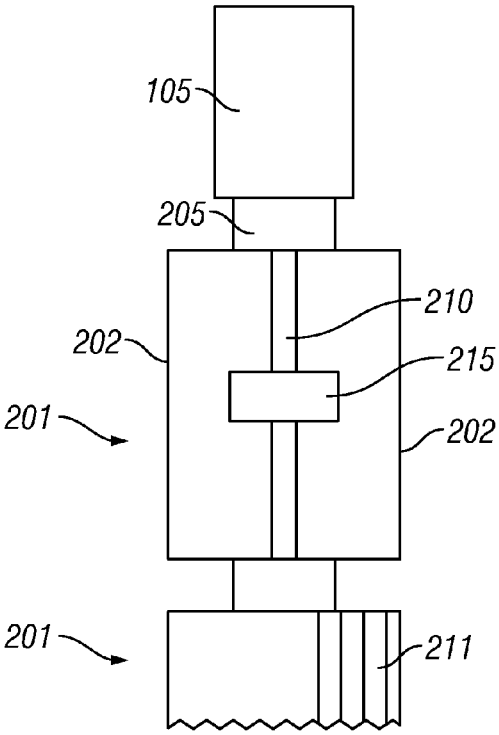
FIGS. 3A-3C schematically illustrate a stress measurement tool according to the principles disclosed herein.
Figure 3B:
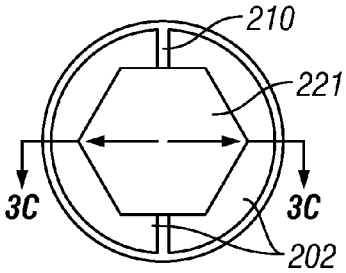
Figure 3C:
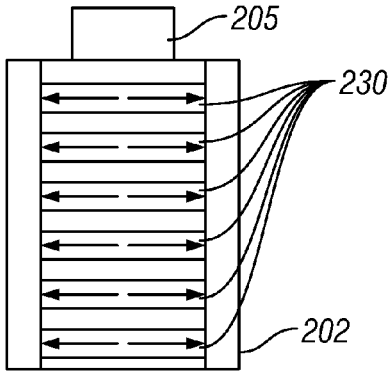

FIG. 2 illustrates a fracture 301 in a formation mechanically induced in accordance with one embodiment. FIGS. 3A-3C schematically illustrate a stress pad section 201 of a stress measurement tool for mechanically inducing the fracture 301 shown in FIG. 2 in accordance with one embodiment. To fracture the formation, two semi-cylindrical pads 202 are forced outward in opposite directions against the wellbore 115. Force against the wellbore 115 is increased until the fracture 301 is induced by overcoming the formation tensile strength. The fracture 301 occurs substantially perpendicular to the force applied by the semi-cylindrical pads 202. After the fracture 301 is opened, the semi-cylindrical pads 202 are withdrawn to allow the fracture to close back. The fracture 301 is then reopened by the semi-cylindrical pads 202 while the stress applied by the semi-cylindrical pads 202 is plotted against strain, which can be measured by a strain gauge 215 monitoring the width of a gap 210 between the semi-cylindrical pads 202. Those having ordinary skill in the art will appreciate that strain in the formation may be measured using various arrangements without departing from the scope of the disclosure. The reopening of the fracture 301 may be repeated using different loading cycles to determine stress magnitudes in the formation.

Continuing with FIGS. 3A-3C, the stress measurement tool includes an upper connection 205 for connecting to the drill string 105, which may include, for example, coiled tubing, drill pipe, and/or drill collars. The stress measurement tool includes at least one stress pad section 201 with two semi-cylindrical pads 202. The length of the semi-cylindrical pads 202 is selected according to the diameter of the wellbore in which they will be used. In one embodiment, the semi-cylindrical pads 202 are about three times as long as the diameter of the wellbore. For example, in a 9⅝ inch (24.4 cm) diameter wellbore, the semi-cylindrical pads 202 may be about 30 inches (76.2 cm) long. The semi-cylindrical pads 202 are separated by the gap 210 when outwardly extended, and may be covered by a screen 211 to prevent debris from interfering with the movement of the semi-cylindrical pads 202.

FIG. 3B is a radial cross-section of the stress pad section 201. The semi-cylindrical pads 202 are extended and retracted by a spline 221. If circulation of fluid is desired through the stress measurement tool, a through bore (not shown) may be formed in the spline 221. The spline 221 is only schematically illustrated because the particular mechanism used is not critical so long as it is capable of providing sufficient outward force to fracture the formation and retracting the semi-cylindrical pads 202 after being pressed into the formation. The semi-cylindrical pads 202 may be constructed to not be entirely rigid in order to conform to the wellbore during fracturing. This may be accomplished through a selection of multiple materials or by having a non-solid structure. For example, an outer portion of the semi-cylindrical pads 202 may be formed from soft metal or high durometer polyurethane.

FIG. 3C is an axial cross-section of the stress pad section 201. To distribute the force evenly along the semi-cylindrical pads 202, a series of jacks 230 may be spaced along the stress pad section 201. The jacks 230 may be actuated, for example, by axial movement of the spline 221.

As discussed above, at least three separate mechanically induced fractures in three directions are necessary to determine the stress field of the formation. Six mechanically induced fractures in six directions allow for determination of the stress field of the formation with fewer assumptions, and, accordingly increased accuracy. The stress measurement tool used to induce the fractures includes at least one stress pad section. A single stress pad section may be used to induce a fracture in a first direction. The single stress pad section may then be moved axially up or down in the wellbore and rotated to a second direction, third direction . . . and sixth direction. Alternatively, each of the fractures may be induced by a different stress pad section simultaneously by using a stress measurement tool that includes three or six stress pad sections oriented in different directions. Simultaneous fracturing saves time relative to sequential fracturing and ensures that the fractures are induced at specific orientations relative to each other.

Figure 4:
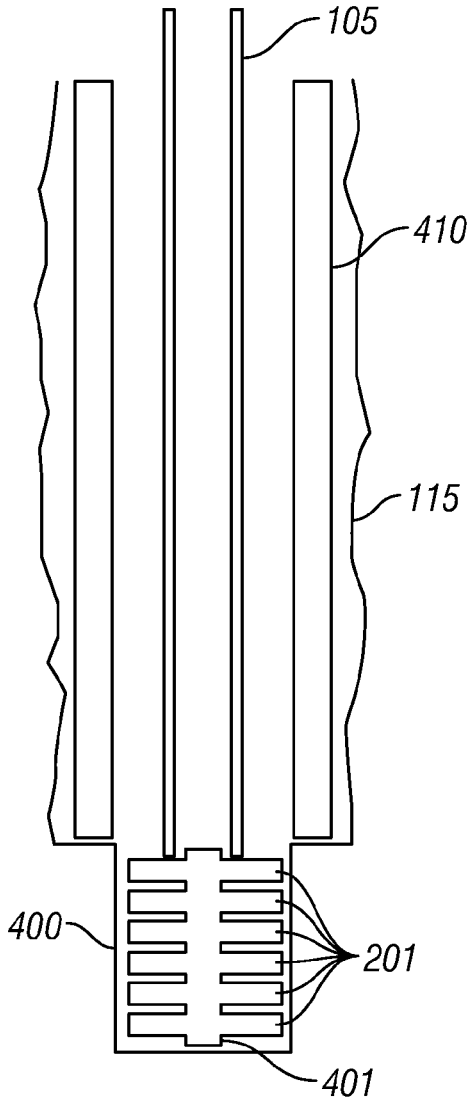
FIG. 4 schematically illustrates a stress measurement tool according to the principles disclosed herein.
Figure 5A:
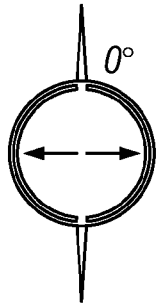
FIGS. 5A-5F illustrate a series of mechanically induced fractures in a formation according to the principles disclosed herein.
Figure 5B:
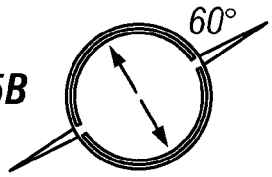
Figure 5C:
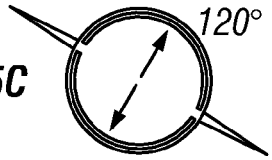
Figure 5D:
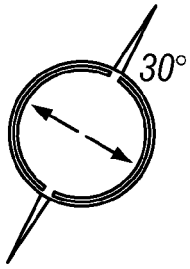
Figure 5E:
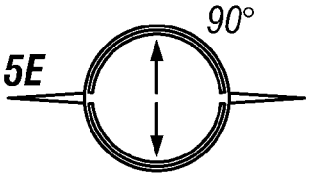
Figure 5F:
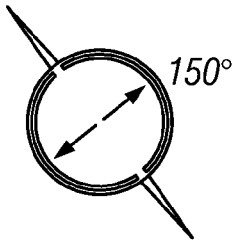

In one embodiment, the stress measurement tool includes six stress pad sections 201 oriented 60 degrees from each other around the stress measurement tool, as schematically shown in FIG. 4. Each stress pad section may be oriented more than 60 degrees from the stress pad sections immediately above and below to minimize interference in the direction of the induced fracture from the neighboring induced fractures. Orientations of six stress pad sections 201 and their corresponding induced fractures are illustrated in FIGS. 5A-5F. In this embodiment, with respect to due north and from the top to the bottom, the stress pad sections 201 are oriented at 0, 60, 120, 30, 90, and 150 degrees. This relative orientation amongst the stress pad sections 201 ensures that a set of stress measurements will be taken every 30 degrees around the wellbore 400.

The stress measurement tool may further include orientation sensors and a gamma ray sensor provided in a sensor module 401 in close proximity to the set of stress pad sections 201. The orientation sensors may be any systems known in the art for determining orientation of a downhole tool, such as gyroscopes and accelerometers. The orientation sensors allow for the determination of the direction in which each stress pad section 201 is oriented. The gamma ray sensor allows for identification of the basic lithology of the formation being tested to help ensure that the stress measurement tool is placed at the desired location in the wellbore 400 below a casing 410.

The above described apparatus allow for the plotting of stress versus strain while opening a mechanically induced fracture in a formation. As discussed above, a fracture is mechanically induced by applying a stress sufficient to overcome the tensile strength of the formation. The fracture is allowed to close and then is reopened by again applying stress. As stress applied by the semi-cylindrical pads increases, the measured strain will be substantially zero from when the semi-cylindrical pads contact the formation until the fracture reopens, at which point stress and strain will have a proportional relationship. The stress magnitude at this inflection point in the stress versus strain plot is related to the tangential stress component generated at the wellbore by the semi-cylindrical pads. This data for each of the induced fractures can then be used to solve for the stress field of the formation, as detailed mathematically below.

Figure 6:
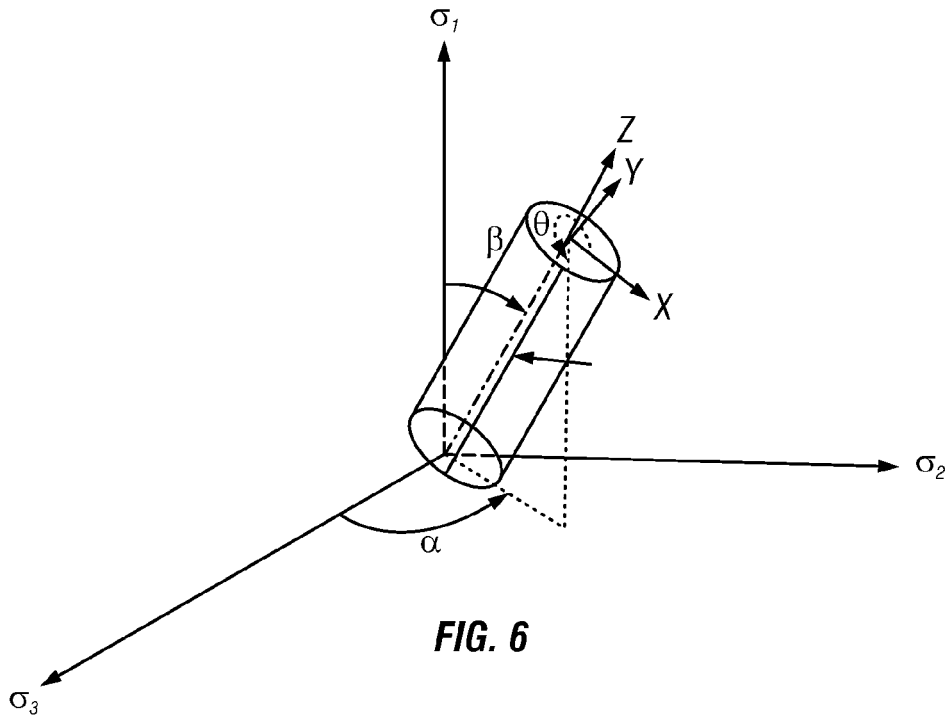
FIG. 6 illustrates a coordinate system for reference with stress field determinations according to the principles disclosed herein.

With reference to FIG. 6, $(\sigma_1, \sigma_2, \sigma_3)$ is a system of rectangular axes and (X, Y, Z) is another set of rectangular axes whose direction cosines relative to $(\sigma_1, \sigma_2, \sigma_3)$ coordinate are, respectively, $(l_1, m_1, n_1)$, $(l_2, m_2, n_2)$, $(l_3, m_3, n_3)$. These direction cosines can be expressed in terms of plunge $\beta$ and trend, $\alpha$ as follows:

$$\left.\begin{array}{lll} l_1 = \cos\beta\cos\alpha, & m_1 = \cos\beta\sin\alpha, & n_1 = -\sin\beta \\ l_2 = -\sin\alpha, & m_2 = \cos\alpha, & n_2 = 0 \\ l_3 = \sin\beta\cos\alpha, & m_3 = \sin\beta\sin\alpha, & n_3 = \cos\beta \end{array}\right\}$$

The explicit form of the stress transformation matrices between the two coordinate reference systems are:

$$[T_e] = \begin{bmatrix} l_1^2 & m_1^2 & n_1^2 & 2m_1n_1 & 2n_1l_1 & 2l_1m_1 \\ l_2^2 & m_2^2 & n_2^2 & 2m_2n_2 & 2n_2l_2 & 2l_2m_2 \\ l_3^2 & m_3^2 & n_3^2 & 3m_3n_3 & 2n_3l_3 & 2l_3m_3 \\ l_2l_3 & m_2m_3 & n_2m_3 & m_2n_3 + m_3n_2 & n_2l_3 + n_3l_2 & l_2m_3 + l_3m_2 \\ l_3l_1 & m_3m_1 & n_3n_1 & m_1n_3 + m_3n_1 & n_1l_3 + n_3l_1 & l_1m_3 + l_3m_1 \\ l_1l_2 & m_1m_2 & n_1n_2 & m_1n_2 + m_2n_1 & n_1l_2 + n_2l_1 & l_1m_2 + l_2m_1 \end{bmatrix}$$

The tangential stress component at the borehole wall when a fracture is reopened can be expressed as:

$$\sigma_{\theta\theta}=\sigma_{xx}+\sigma_{yy}-2(\sigma_{xx}-\sigma_{yy})\cos 2\theta-4\tau_{xy}\sin 2\theta-P_w=kP_r$$

When a fracture is reopened, the tangential stress generated by the in-situ stress regime described above is substantially equal to the tangential stress generated by loading of the stress measurement tool. The reopening pressure $P_r$ may be recorded by observing the stress-strain curve measured by strain sensors. The stress concentration factor k can be calibrated using numerical simulation. Therefore, with six fractures generated by a stress measurement tool, there are six equations to solve for the six unknowns $\sigma_1$, $\sigma_2$, $\sigma_3$, $\alpha$, $\beta$, $\theta$.

Figure 7:
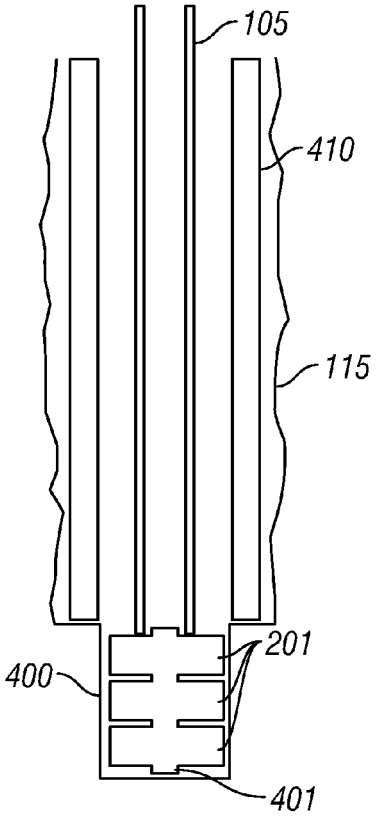
FIG. 7 schematically illustrates a stress measurement tool according to the principles disclosed herein.
Figure 8A:
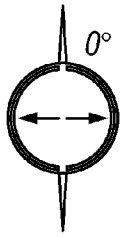
FIGS. 8A-8C illustrate a series of mechanically induced fractures in a formation according to the principles disclosed herein.
Figure 8B:
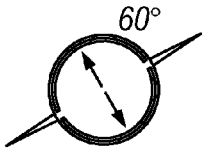
Figure 8C:
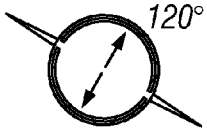

Although six fractures provide a more accurate stress field determination, three fractures may provide sufficient information for determining a stress field to obtain many of the advantages of the principles disclosed herein. FIG. 7 illustrates a stress measurement tool for mechanically inducing three or more fractures in accordance with one embodiment. In this embodiment, the stress measurement tool includes three stress pad sections 201 oriented in different directions to mechanically induce the fractures shown in FIGS. 8A-8C. Orientation sensors and a gamma ray sensor may be provided in a sensor module 401 in close proximity to the set of stress pad sections 201. In this embodiment, with respect to due north and from the top to the bottom, the stress pad sections 201 are oriented at 0, 60, and 120 degrees.

In a simplified form, assuming the vertical stress is one of the principal stress components of the in-situ stress, and with a further simplification of a plain strain assumption, we have the following equation for tangential stress when a fracture is reopened:

$$\sigma_{\theta\theta}\sigma_1+\sigma_2-2(\sigma_1-\sigma_2)\cos 2\theta-P_w=kP_r$$

There are only three unknowns $\sigma_1$, $\sigma_2$ and $\theta$. Therefore, with only three fractures generated, there are three equations to solve for the three unknowns. If additional fractures are desired, the stress measurement tool may be lowered or raised within the wellbore and rotated about 30 degrees to open another set of three fractures to obtain all six of the datasets needed for full analysis without the simplifying assumptions regarding the vertical stress and plain strain.

Figure 9A:
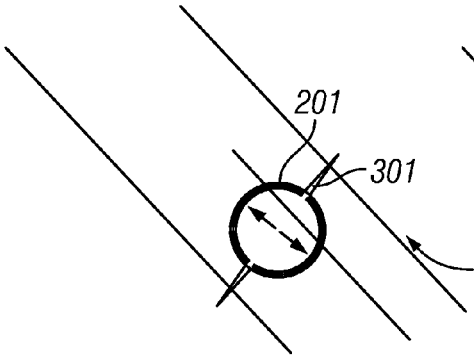
FIGS. 9A and 9B illustrate mechanically induced fractures in a formation with pre-existing fractures according to the principles disclosed herein.
Figure 9B:
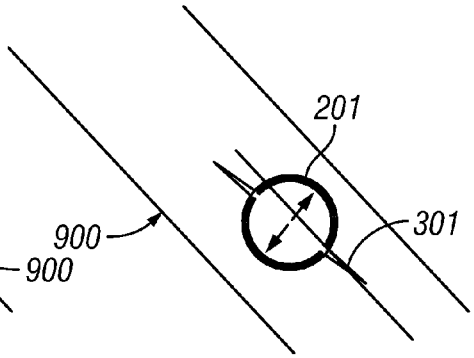

Some formations contain natural fractures. Stress measurement tools in accordance with the principles disclosed herein may be used with such formations. If the existence and orientation of natural fractures in the formation are known in advance, the stress measurement tool may be oriented to put the natural fractures in the compressive stress zone to minimize the influence of the natural fractures on the measurements being taken. Such an alignment is shown in FIG. 9A in which the mechanically induced fracture 301 is oriented to avoid opening the natural fracture 900. Alternatively, the natural fracture 900 may be reopened mechanically by substantially aligning the mechanically induced fracture 301 parallel to the natural fracture 900, as shown in FIG. 9B.

If the existence and/or orientation of natural fractures are unknown, stress measurement tools in accordance with the principles disclosed herein may be used to determine these formation properties. If a natural fracture is opened by one of the stress pad sections 201, the plot of stress versus strain during the initial mechanical fracture will more closely resemble the reopening of the fracture instead of the creation of the fracture.

Stress measurement tools and stress field determination methods disclosed herein provide direct downhole measurement of the directions and magnitudes of the components of the stress field in a formation under the conditions of downhole temperature and stress that are present at the time of the test. These downhole stress measurements are then used to provide a general solution to the downhole stress measurement problem that is not limited by either hole angle or bed dip. Stress field orientations, magnitudes, and the natural fracture orientation are key parameters needed to plan successful hydraulic fracturing in reservoirs, in designing well orientation, and to predicting the production delivery (flow rates and reserves) of a reservoir. The true stress field is usually not what it is assumed to be, or what it is mathematically simplified to be, when using existing techniques and tools. In the prior art, commonly only the minimum horizontal stress component can be measured to a reasonable degree of accuracy with different inherent assumptions and simplifications. The orientation and magnitude of the maximum horizontal stress component are usually only estimated and rarely directly measured.

Direct measurement of the subsurface stress is a key unknown in designing fracture stimulation, in orienting the drilling of wellbores, and in predicting the effectiveness of a hydraulic fracture on both initial production rates and ultimate reservoir recovery. Many different methods are available to estimate these important parameters, but none are designed to measure all of these parameters under in-situ conditions.

Stress measurement tools in accordance with the principles disclosed herein can replace the use of downhole formation integrity test (FIT) measurements because the actual values of the stresses would be known from the stress measurement tools. Hydraulic fracturing measurements do not provide as much information as mechanically induced fractures disclosed herein. For example, the orientation and magnitude of the downhole stress system could be determined at multiple depths in the wellbore by setting the stress measurement tool at varying depths for data acquisition. The parameters of the existing natural fracture system in the subsurface are also determinable from the stress measurement tools disclosed herein.

Direct measurement and identification of downhole stresses may positively impact many different areas related to the drilling, stimulation, casing, cementing and completion of wells.

In fracturing operations, identification of the orientation of natural fractures and the determination of their relationship to the current stress regime is important especially in tight gas and shale reservoirs because the fractures that are oriented preferentially to the current stress state will be the ones that are currently open and that can provide the most effective deliverability of hydrocarbons to the wellbore. Furthermore, a full measurement of the present stress regime will allow the analysis of the relationship between the natural fractures and the geologic time at which they were generated.

Identification of the stress state in the subsurface at any point in the wellbore will allow the identification of changes in the stress vertically due to any combination of geologic and lithologic factors. This is currently an unknown that is evaluated by modeling, but that cannot be directly confirmed by the well data. For example, on a tightly folded structure, even in a present-day compressive stress regime, the reservoirs at the top of the folded structure may be in extension with neutral horizontal stress in the middle and strongly compressive stresses at the most tightly folded part of the structure. The identification of the open fractures and their orientation and location on the structure will often determine the success or failure of a well. As another example, the stress state around salt and diapiric shale bodies changes dramatically due to the nature of the mobile rock. This affects the design, drilling, and completion of these wells.

The successful artificial fracturing of wells in shale and tight sands is of significant importance to the ability to produce hydrocarbons from such reservoirs. Improved knowledge of the current stress state allows for improvement in the design and stimulation of such wells. In addition to the relationship between fracture orientation and conductivity to the current stress state, the permeability of the reservoir rock itself is anisotropic and is related to the stress field. Identification of this early in the development of a field will allow for the better placement and design of the development wells.

Improved knowledge of the stress field can improve the drilling process. The direction in which wells should be drilled to achieve maximum commercial success is related to the stress state and fracture pattern of the formations. The design of the well drilling program is also related to both the rock strength and to the stress state. The interval in which the hole angle is built and the angle of build-up is important in the drilling of successful wells.

In overpressured downhole environments, the knowledge of the stress state in the rocks, including pore pressure, is needed to design the drilling plan to allow for safe and efficient construction of the wells to include the casing plan, the mud weight design, the bit selection, the cementing program, the direction that the wells are drilled, the units in which angle build-up will be done, and the rate of hole angle increase, as well as many other factors. The prevention or management of wellbore instability is based on an analysis of the downhole stress conditions. Direct measurement of the downhole stresses may also allow for better identification and analysis of chemical reactions between the rock and the mud or cement system by allowing the separation of the causes of the various effects. Rock strength and stress are also important factors in the selection of the proper bit that will most efficiently drill any specific rock unit in the subsurface.

The production from a reservoir may be improved with increased knowledge of the stress field of the formations. Production and depletion of a reservoir of any lithology changes the stress state within and around that reservoir. The results can be either beneficial or deleterious depending on a number of factors. Stress measurement tools disclosed herein may allow the measurement of the change in stress as measured by infill or development or redevelopment wells after the production has begun with a greater accuracy and precision than is currently done. Additionally, casing collapse due to subsurface faulting or the movement of salt or mobile shale can be analyzed and mitigated by the analysis of the stress conditions using the stress measurement tools disclosed herein.

Those having ordinary skill in the art will appreciate that the analysis of the stress and strain data obtained by stress measurement tools disclosed herein may occur within electronic components in the stress measurement tool or at the surface. In one embodiment, the stress and strain measurements may be stored on computer readable media in the stress measurement tool and then analyzed when the stress measurement tool is retrieved from the well. In another embodiment, the stress and strain measurements may be communicated from the stress measurement tool to the surface. The data may be communicated to the surface by pressure pulses in well fluid, electronically through wired drill pipe, or through any other downhole telemetry system.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A method of determining a stress field in a subterranean formation, comprising:

deploying a stress measurement tool on a tubular string;

opening at least three fractures in three different radial directions in the subterranean formation;

closing the at least three fractures;

reopening the at least three fractures while measuring stress and strain conditions;

from the reopening, determining a tangential stress component for each of the at least three fractures; from the tangential stress component and radial directions of the at least three fractures, determining the stress field of the subterranean formation, wherein the at least three fractures are mechanically induced by a stress measurement tool comprising at least three stress pad sections, each stress pad section comprising two semi-cylindrical pads movable in a substantially radial direction towards and away from each other to open and close the fractures, wherein, when opening and closing three fractures, the at least three stress pad sections are actuated substantially at the same time to open and close the fractures, and wherein the stress field of the subterranean formation comprises at least two principal stresses and an angle between one of the at least two principal stresses and a coordinate axis.

2. The method of claim 1, wherein six fractures are opened in six different radial directions, closed, and reopened.

3. The method of claim 2, wherein the six fractures are mechanically induced by the stress measurement tool comprising six stress pad sections, each stress pad section comprising two semi-cylindrical pads movable in a substantially radial direction towards and away from each other to open and close the fractures.

4. The method of claim 3, wherein the six stress pad sections are actuated substantially at the same time to open and close the fractures.

5. The method of claim 2, wherein the six fractures are oriented at least 30 degrees from any other fracture.

6. The method of claim 5, wherein each fracture is oriented about 60 degrees from any neighboring fracture.

7. The method of claim 1, wherein at least one of the at least three fractures is a natural fracture in the subterranean formation.

8. The method of claim 1 wherein the at least two principal stresses comprises three principal stresses and determining the stress field of the subterranean formation further comprises determining a plunge and a trend.

9. A stress measurement tool for a subterranean formation, comprising:

a connection on an upper end of the stress measurement tool for connecting to a tubular string;

a directional sensor for determining the orientation of the stress measurement tool; and at least three stress pad sections, wherein each stress pad section comprises, two semi-cylindrical pads movable in a substantially radial direction towards and away from each other and oriented in a different radial direction from the two semi-cylindrical pads in the other stress pad sections, and wherein each stress pad section is oriented at least 60 degrees from a stress pad section immediately above and at least 60 degrees from a stress pad section immediately below;

a stress sensor for monitoring the stress applied by the two semi-cylindrical pads to the subterranean formation, a strain sensor for monitoring the opening and closing of a fracture in the subterranean formation, wherein data from the strain sensor is correlated with data from the stress sensor, and wherein at least three of the stress pad sections are actuatable at substantially the same time.

10. The stress measurement tool of claim 9, further comprising:

a gamma ray sensor.

11. The stress measurement tool of claim 9, wherein the stress measurement tool comprises six stress pad sections.

12. The stress measurement tool of claim 11, wherein the two semi-cylindrical pads of each of the six stress pad sections are actuatable at substantially the same time.

13. The stress measurement tool of claim 11, wherein each stress pad section is rotated at least 60 degrees relative to any adjacent stress pad section.

14. The stress measurement tool of claim 9, wherein a gap between the two semi-cylindrical pads is covered.

15. The stress measurement tool of claim 9, wherein the two semi-cylindrical pads conform to the subterranean formation.

16. The stress measurement tool of claim 9, wherein the stress measurement tool is controlled through signals transmitted through the connection.

* * * * *